US005394783A

United States Patent [19]

Sperzel

[11] Patent Number: 5,394,783

[45] Date of Patent: Mar. 7, 1995

[54] STRING SUPPORT AND METHOD

[76] Inventor: Robert J. Sperzel, Marine Tower-East, Unit 1503, 12520 Edgewater Dr., Lakewood, Ohio 44107

[21] Appl. No.: 68,122

[22] Filed: May 25, 1993

Related U.S. Application Data

[63] Continuation-in-part of Ser. No. 963,074, Oct. 19, 1992.

[51] Int. Cl.[6] ..... G10D 3/00

[52] U.S. Cl. ..... 84/297 R; 84/307; 84/314 N

[58] Field of Search ..... 84/297 R, 298, 299, 84/307, 308, 309, 314 N, 267, 268, 269, 274

[56] References Cited

U.S. PATENT DOCUMENTS 4,304,163 12/1981 Siminoff ..... 84/307
5,173,565 12/1992 Gunn ..... 84/307
5,260,504 11/1993 Turner ..... 84/297 R

*Primary Examiner*—Michael L. Gellner
*Assistant Examiner*—Cassandra C. Spyrou
*Attorney, Agent, or Firm*—Tarolli, Sundheim & Covell

[57] ABSTRACT

A stringed musical instrument of the guitar type has a plurality of strings which extend from tuning devices on a head portion, along a neck portion, to a body portion of the instrument. A plurality of string support assemblies are mounted in the material of the musical instrument adjacent to a connection between the head and neck portions of the instrument. Each of the string support assemblies includes a pair of spheres which are held in engagement with each other. One of the strings presses against a pair of spheres to position the string relative to the head and neck portions of the instrument. In one embodiment of the invention, the spheres have different diameters. In this embodiment of the invention, the string bends around the larger one of the two spheres. The spheres, whether of the same diameter or of different diameters, are disposed in a recess which extends part way through the string support. An end of the recess is blocked by material which is received in the recess. To block the end of the recess, a punch removes material from a sheet and presses it into an open end of the recess.

42 Claims, 3 Drawing Sheets

STRING SUPPORT AND METHOD

RELATED APPLICATION

This application is a continuation-in-part of application Ser. No. 07/963,074, filed Oct. 19, 1992, by Robert J. Sperzel and entitled "String Support for Musical Instrument". The benefit, under Title 35, United States Code §120 of the earlier filing date of the aforementioned application Ser. No. 07/963,074 has been and hereby is claimed for all subject matter common to this application and the aforementioned application Ser. No. 07/963,074.

BACKGROUND OF THE INVENTION

The present invention relates to a new and improved string support assembly for use with a guitar or a similar stringed instrument to position strings relative to the instrument and to a method by which the string support assembly is formed.

Stringed musical instruments of the guitar type commonly have a body portion, a neck portion which extends outwardly from the body portion, and a head portion connected with an end of the neck portion opposite from the body portion. A plurality of tuning devices are mounted on the head portion and are operable to adjust the tension in strings which extend from the head portion along the neck portion to the body portion of the instrument. A nut or string support system is provided adjacent to a connection between the head and neck portions of the instrument. The nut positions the strings relative to the neck portion of the instrument.

The manner in which the nut cooperates with the strings is very important in obtaining the desired tone from the instrument. Thus, the nut must be accurately located to determine the effective length of the strings. The nut must hold the strings against sidewise movement in order to avoid a buzzing sound effect. During the operation of a tremolo, the nut should allow the tension in the strings to be varied in a predictable manner. The nut should be constructed in such a manner as to enable a uniform spacing to be obtained between each of the strings and the frets on the neck of the guitar.

In the past, the nut has included a straight piece of material in which slots are formed. Substantial care and effort is required to form the slots in the nut with a width which corresponds exactly to the diameter of the strings to prevent sidewise movement of the strings. In addition, the orientation of the slots must be carefully and accurately determined to have the strings go straight back from a front edge of the nut to the tuning devices on the head portion of the guitar. In addition, substantial effort must be expended to form the slots with a depth which will result in each of the strings being spaced the same distance from an arcuate upper side surface on each of the frets on the neck of the guitar. Unfortunately, after the guitar is used over a period of time, the nut wears and must be replaced.

SUMMARY OF THE INVENTION

An improved string support system is used in a musical instrument of the guitar type. This type of musical instrument commonly has a plurality of strings which extend from tuning devices on a head portion, along a neck portion, to a body portion of the instrument. The improved string support system positions the strings relative to the head and neck portions of the instrument.

The string support system includes a plurality of string support assemblies. Each of the string support assemblies has a pair of convex arcuate surfaces which cooperate to engage a string. The convex arcuate surfaces may be disposed on spherical members having different diameters. The spherical members may be rotatably held in a recess formed in a support member. The support member may be mounted directly in the material of the instrument.

The spherical members are advantageously retained in a recess by material which is inserted into an open end of the recess. To insert the material in the open end of the recess, a punch or similar member removes material from a sheet of material. The punch then presses the material removed from the sheet of material into the open end of the recess.

BRIEF DESCRIPTION OF THE DRAWINGS

The foregoing and other features of the present invention will become more apparent upon a consideration of the following description taken in connection with the accompanying drawings wherein.

DESCRIPTION OF SPECIFIC PREFERRED EMBODIMENTS OF THE INVENTION

Figure 1:
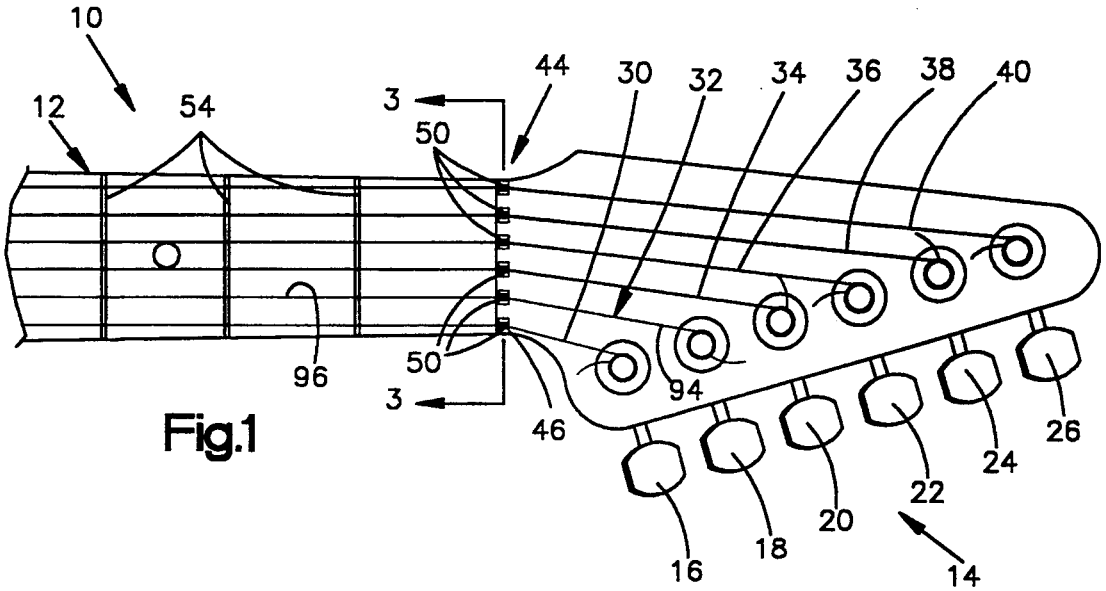
FIG. 1 is a fragmentary and somewhat schematicized plan view illustrating the relationship between a neck portion, head portion and a plurality of strings in a musical instrument of the guitar type.

A portion of a guitar 10 is shown in FIG. 1. The guitar 10 includes a body portion (not shown) having a sounding board. A neck portion 12 extends outwardly from the body portion of the guitar. A head portion 14 is connected with the neck portion 12. The head and neck portions 12 and 14 are formed of wood. However, the head and/or neck portions 12 and 14 could be formed of a different material if desired.

A plurality of tuning devices 16, 18, 20, 22, 24 and 26 are provided on the head portion 14. The tuning devices 16–26 are operable to adjust the tension in strings 30, 32, 34, 36, 38 and 40 in a known manner. The tuning devices 16–26 are advantageously constructed in the manner disclosed in U.S. Pat. No. 4,625,614.

The strings 30–40 extend from the tuning devices 16–26 in the head portion 14 along the neck portion 12 of the guitar to the body portion of the guitar. A tremolo may be provided on the body portion to vary the tension in the strings 30–40 in a known manner. The general construction of the guitar 10 is well known and may be in accordance with the construction of may different commercially available guitars.

An improved string support system 44 constructed in accordance with the present invention is provided adjacent to a connection 46 between the neck and head portions 12 and 14 of the guitar 10. The string support system 44 positions the strings 30–40 relative to the neck portion 12 of the guitar. The string support system 44 performs functions performed by a nut in known guitars.

The improved string support system 44 includes a plurality of identical string support assemblies 50 which are disposed in a linear array. There is a string support assembly 50 for each of the strings 30–40. The string support assemblies 50 engage the strings to locate them relative to each other and to frets 54 on the neck portion 12 of the guitar 10.

Figure 2:
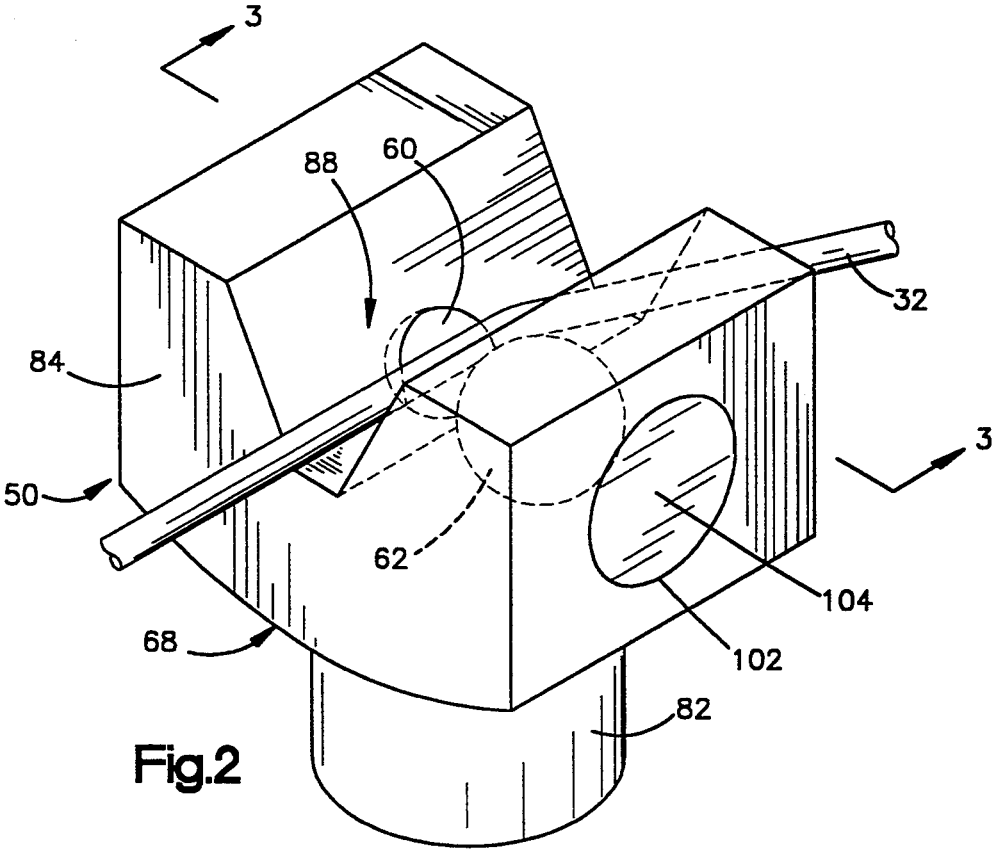
FIG. 2 is a pictorial illustration of an improved string support assembly constructed in accordance with the present invention.
Figure 3:
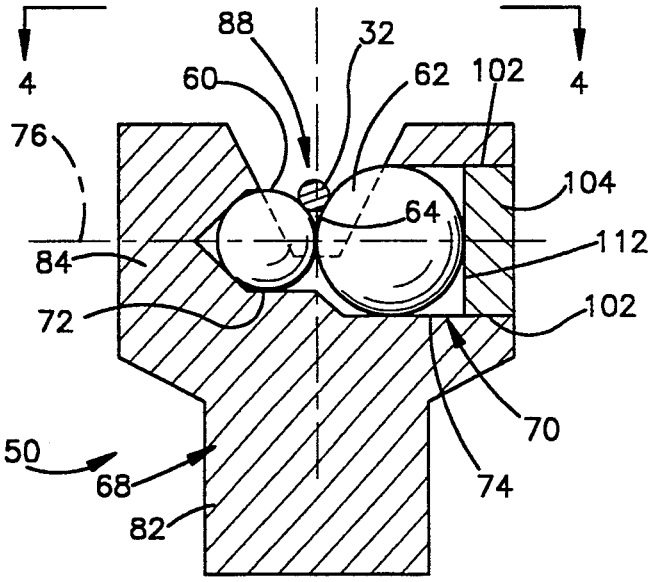
FIG. 3 is a sectional view, taken generally along the line 3—3 of FIG. 2, illustrating the relationship of a pair of spheres to a recess in a body of the string support assembly.
Figure 4:
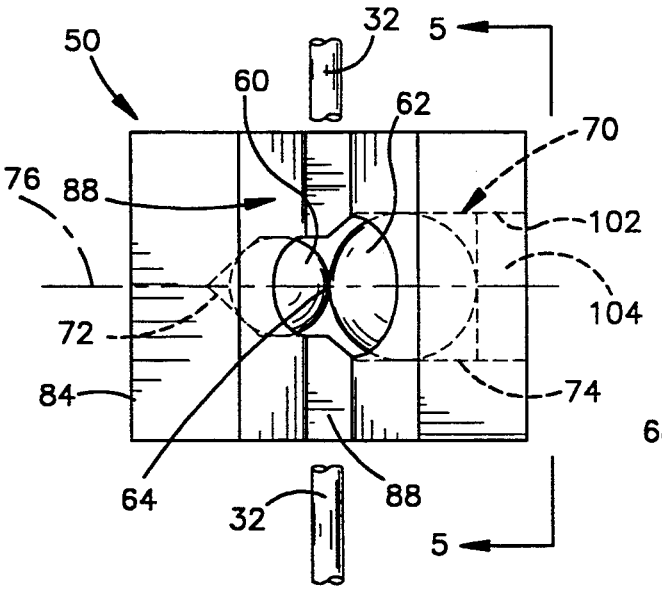
FIG. 4 is a plan view, taken generally along the line 4—4 of FIG. 3, further illustrating the relationship of the spheres to the body of the string support assembly.
Figure 5:
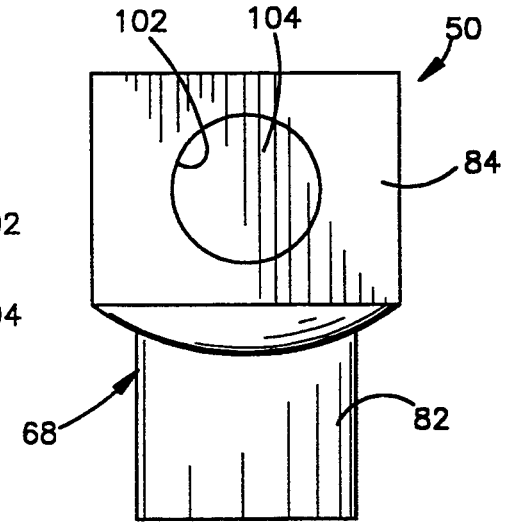
FIG. 5 is a side elevational view, taken generally along the line 5—5 of FIG. 4, illustrating the manner in which an end of the recess holding the spheres is blocked.

Each of the string support assemblies 50 includes a pair of spheres or balls 60 and 62 (FIGS. 2, 3 and 4). The spheres 60 and 62 are formed of metal (steel) and have convex arcuate surfaces which support one of the strings, for example the string 32. In accordance with one of the features of the invention, the spheres 60 and 62 may have different diameters. Thus, the sphere 62 is larger than the sphere 60. Although it is preferred to use a pair of spheres or balls 60 and 62 in the string support assembly 50, either a single member or a pair of non-spherical members could be formed with convex arcuate surface areas 7hich are engaged by one of the strings 30–40.

The spheres 60 and 62 enable the string 32 (FIGS. 3 and 4) to be supported at a predetermined location along the neck 12 of the guitar 10 to provide an accurately located intonation point for the string. The spheres 60 and 62 also accurately locate the string 32 relative to the frets 54 on the neck portion 12 of the guitar 10. By providing a separate string support assembly 50 for each of the strings 30–40, the height of each of the strings above the frets 54 can be the same even though the frets have curved outer side surfaces.

In addition to accurately locating the strings 30–40, the spheres 60 and 62 cooperate with the strings to hold them against sideways movement at the string support system 44. This minimizes objectionable noise or buzzing. The convex arcuate outer side surfaces of the spheres 60 and 62 enable the strings 30–40 to either extend in a continuous straight line along the neck portion 12 and head portion 14 or to bend at the string support system 44, as shown in FIG. 1. This enables the string support assemblies 50 to be used with guitars having tuning devices in almost any desired location on the head portion of the guitar.

The spheres 60 and 62 in the plurality of string support assemblies 50 enable the strings 30–40 to have different diameters. Thus, the diameters of the strings 30–40 progressively increase from a relatively small diameter string 30 to a relatively large diameter string 40. The reason that the identical string support assemblies 50 can be used with the strings of different diameters is that the convex arcuate outer side surfaces of the spheres 60 and 62 cooperate to form a recess or nip 64 7hich tapers downward (as viewed in FIG. 3). The tapering nip 64 allows the spheres 60 and 62 to engage opposite sides of strings 30–40 having different diameters and to hold the different diameter strings against sideways movement. The hardened metal (steel) spheres 60 and 62 preferably have diameters which are greater than the diameters of the strings.

Each of the string support assemblies 50 includes a metal (brass) body or support member 68 (FIGS. 2 and 3). A recess 70 (FIG. 3) extends part way through the one-piece body 68. The recess 70 includes a relatively small diameter cylindrical inner end portion 72 (FIG. 3) and a relatively large diameter cylindrical outer end portion 74. The inner and outer end portions 72 and 74 of the recess 70 are disposed in a coaxial relationship.

The small sphere 60 is disposed in the inner end portion 72 of the recess 70. The large sphere 62 is disposed in the outer end portion 74 of the recess 70. The spheres 60 and 62 are disposed in the recess 70 with their centers on a central axis 76 of the recess 70.

In the embodiment of the string support assembly 50 illustrated in FIG. 3, the inner end portion 72 and outer end portion 74 of the recess 70 are disposed in a coaxial relationship. However, it is contemplated that the inner end portion 72 of the recess 70 could be offset from the outer end portion 74 of the recess 70.

When the string 32 is flexed during playing of the guitar 10, for example during actuation of a tremolo, the string 32 (FIGS. 3 and 4) is free to move along its longitudinal axis relative to the spheres 60 and 62. As the string 32 moves axially relative to the spheres 60 and 62, the spheres are rotated in opposite directions about their centers by forces transmitted from the string 32 to the spheres. Thus, if the string 32 was moved axially in an upward direction (as viewed in FIG. 4), the sphere 60 would rotate in a counterclockwise direction about its center while the sphere 62 would rotate in a clockwise direction about its center.

Allowing the spheres 60 and 62 to rotate under the influence of force transmitted to the spheres by the string 32 eliminates any possibility of binding or jamming of the string 32 in the string support assembly 50. This tends to maximize the effect which can be obtained by the use of a tremolo. Of course, if desired, the spheres 60 and 62 could have an interference fit with a cylindrical inner side surface (FIG. 2) of the recess 70 so that the spheres would not rotate in the recess.

The body 68 of the string support assembly 50 includes a cylindrical base or mounting section 82 (FIGS. 2 and 3) which is received in a cylindrical hole or recess formed in the wooden material of the musical instrument 10. Thus, a linear array of spaced apart cylindrical openings is formed in the wooden material of the guitar 10 adjacent to the connection 46 (FIG. 1) between the neck and head portions 12 and 14. The cylindrical openings in the wooden material of the guitar have parallel central axes.

The string support assembly 50 of each of the strings 30–40 is received in one of the openings formed in the material of the guitar 10. Therefore, vibrations can be transmitted directly from the strings 30–40 to the wooden material of the guitar 10 through each of the string support assemblies 50. Of course, the guitar 10 could be formed of a material other than wood if desired.

The spheres 60 and 62 are disposed in the recess 70 formed in a rectangular sphere support section 84 (FIGS. 2, 3, 4 and 5) of the string support assembly 50. The rectangular sphere support section 84 is larger than a cylindrical mounting section 82 and extends outwardly from the cylindrical mounting section.

A truncated V-shaped slot of passage 88 is formed in the rectangular sphere support section 84 of the body 68 (FIGS. 2, 3 and 4). The slot 88 extends downwardly (as viewed in FIG. 3) past the longitudinal axis 76 of the recess 70 and the centers of the spheres 60 and 62. The slot 88 receives the string 32 and enables the string to move into the rectangular sphere support section 84 of the body 68 for a distance sufficient to engage the spheres 60 and 62. In addition, the slot 88 is wide enough to enable the string 32 to bend at the location where the string engages the spheres 60 and 62. The longitudinal central axis of the slot 78 extends perpendicular to the longitudinal central axis 76 of the recess 70.

In accordance with a feature of the embodiment of the invention illustrated in FIGS. 1–5, the spheres 60 and 62 have different diameters. Thus, the sphere 60 is smaller than the sphere 62. The string 32 bends around the relatively large diameter sphere 62. Thus, the string 32 extends from the tuning device 18 (FIG. 1) along a linear path to one of the string support assemblies 50. The string 32 then extends from the one string support assembly 50 along a second linear path. The linear path along which the string extends from the tuning device 18 to the string support assembly 50 is skewed relative to the path along which the string 32 extends from the one support assembly 50. At the string support assembly 50, an arcuate bend in the string 32 interconnects two linear portions of the string.

Figure 6:
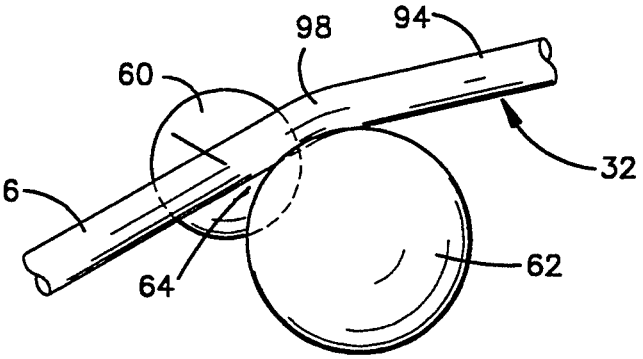
FIG. 6 is a highly schematicized illustration depicting, in a somewhat exaggerated manner, the relationship of a string of the musical instrument to the spheres in the string support assembly of FIGS. 2–5.

Thus, the string 32 has a linear portion 94 (FIG. 6) which extends from the tuning machine 18 (FIG. 1) to the string support assembly 50. The string 32 also has a linear portion 96 (FIG. 6) which extends from the string support assembly 50 to the bridge (not shown) of the musical instrument. In FIG. 6, the angle between the two linear portions 94 and 96 of the string 32 has been exaggerated for purposes of clarity of illustration.

The linear portions 94 and 96 of the string 32 are interconnected by an arcuate bend portion 98 (FIG. 6). The arcuate bend portion 98 engages the nip 64 (FIG. 3) between the two spheres 60 and 62. The bend portion 98 (FIG. 6) is wrapped around the relatively large sphere 62 and has an arc of curvature which is substantially the same as the arc of curvature of the sphere 62. Thus, the arcuate bend portion 98 of the string 32 has a center of curvature which is substantially coincident with the center of the sphere 62. The relatively large diameter sphere 62 is effective to hold the string 32 in place during vibration of the string 32 as the musical instrument 10 is played.

Figure 7:
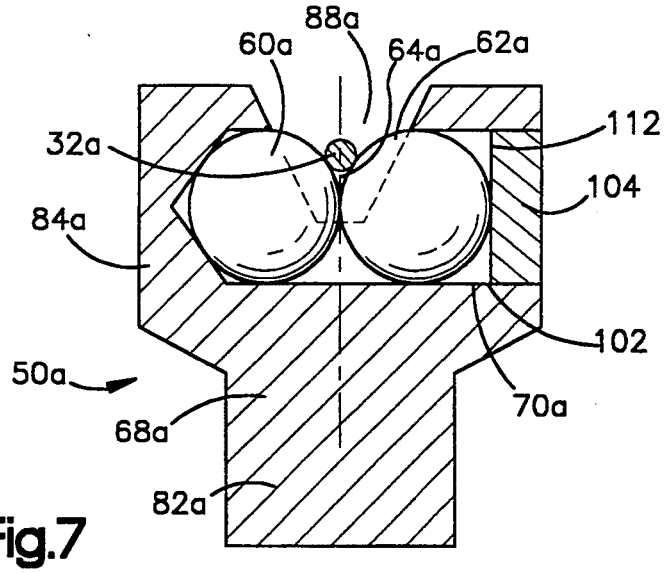
FIG. 7 is a sectional view, generally similar to FIG. 3, of a second embodiment of the string support assembly.

In the embodiment of the invention illustrated in FIGS. 1–6, the spheres 60 and 62 have different diameters. It is believed that the relatively large diameter sphere 62 will be particularly advantageous to enable the string 32 to be bent around the sphere and held in place. However, it is contemplated that the spheres 60 and 62 could have the same diameter. This is particularly true when the strings of the musical instrument are substantially straight. In the embodiment of the invention illustrated in FIG. 7, the spheres are of the same size. Since the embodiment of the invention illustrated in FIG. 7 is generally similar to the embodiment of the invention illustrated in FIGS. 1–6, similar numerals will be utilized to designate similar components, the suffix letter "a" being associated with the numerals of FIG. 7 to avoid confusion.

A string support assembly **50*a* (FIG. 7) has a body 68*a* with a recess 70*a* in which a pair of spheres 60*a* and 62*a* are disposed. In accordance with a feature of this embodiment of the invention, the spheres 60*a* and 62*a* have the same diameter. The spheres 60*a* and 62*a* are disposed in the recess 70*a* with their centers disposed on a longitudinal central axis of the recess 70*a***.

A truncated V-shaped slot **88*a* is formed in the sphere support section 84*a* of the body 68*a*. The slot 88*a* extends downwardly (as viewed in FIG. 7) past the longitudinal axis of the cylindrical recess 70*a* and the centers of the spheres 60*a* and 62*a*. The slot 88*a* receives a string 32*a* and enables the string to move into the body for a distance sufficient to engage the spheres 60*a* and 62*a*. The longitudinal central axis of the slot 88*a* extends perpendicular to the longitudinal central axis of the cylindrical recess 70*a***.

The cylindrical mounting section **82*a* of the body 68*a* is received in a cylindrical recess formed in the wooden material of the musical instrument with which the string support assembly 50*a* is associated. Thus, a linear array of spaced apart cylindrical openings is formed in the wooden material of the musical instrument adjacent to a connection between the neck and head portions of the musical instrument. Therefore, vibrations can be transmitted directly from the strings to the wooden material of the musical instrument through each of the string support assemblies 50*a***. Of course, the musical instrument could be formed of a material other than wood if desired.

Figure 8:
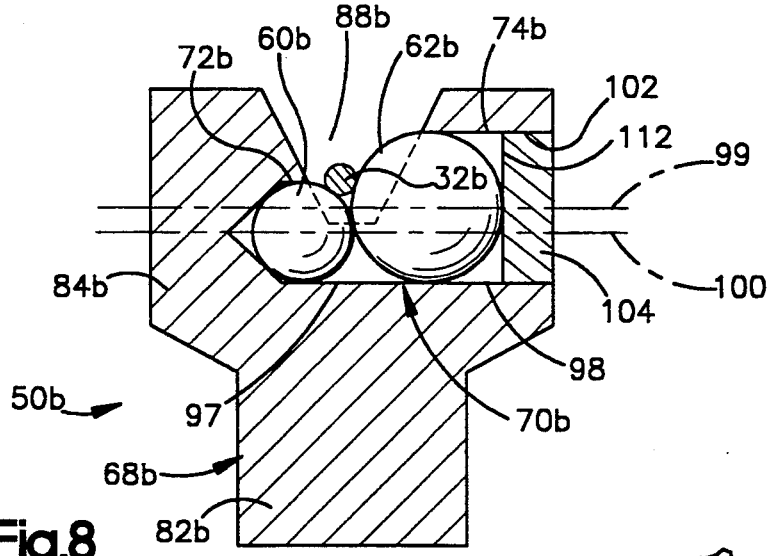
FIG. 8 is a sectional view, generally similar to FIG. 3, of a third embodiment of the string support assembly.

In the embodiment of the invention illustrated in FIGS. 1–6, the recess has coaxial inner and outer end portions 72 and 74. In the embodiment of the invention illustrated in FIG. 8, the end portions of the recess are offset. Since the embodiment of the invention illustrated in FIG. 8 is generally similar to the embodiment of the invention illustrated in FIGS. 1–6, similar numerals will be utilized to designate similar components, the suffix letter "b" being associated with the numerals of FIG. 7 to avoid confusion.

A string support assembly **50*b* has a body 68*b* with a recess 70*b* in which a pair of spheres 60*b* and 62*b* are disposed. The spheres 60*b* and 62*b*** have different diameters.

The recess **70*b* extends part way through the body 68*b*. The recess 70*b* includes a relatively small diameter cylindrical inner end portion 72*b* and a relatively large diameter cylindrical outer end portion 74*b*. The inner end portion 72*b* has a lower (as viewed in FIG. 8) portion 97 which is aligned with a lower portion 98 of the outer end portion 74*b* of the recess 70*b*. The inner portion 72*b* has a central axis 99 which is offset from and parallel to a central axis 100 of the outer portion 74*b* of the recess 70*b*. The small sphere 60*b* has a center disposed on the axis 100 and the large sphere 62*b* has a center disposed on the axis 99**.

In accordance with another feature of the present invention, the recess 70 (FIG. 3), the recess **70*a* (FIG. 7) and the recess 70*b* (FIG. 8) have open ends 102 which are blocked by circular disc-shaped pieces 104. The disc-shaped pieces 104 are received in the cylindrical outer end portions of the recesses 70, 70*a*, and 70*b*. Spheres 62, 62*a*, and 62*b* are pressed against the adjacent spheres 60, 60***a*, and 60*b* by the circular disc-shaped pieces 104.

Figure 9:
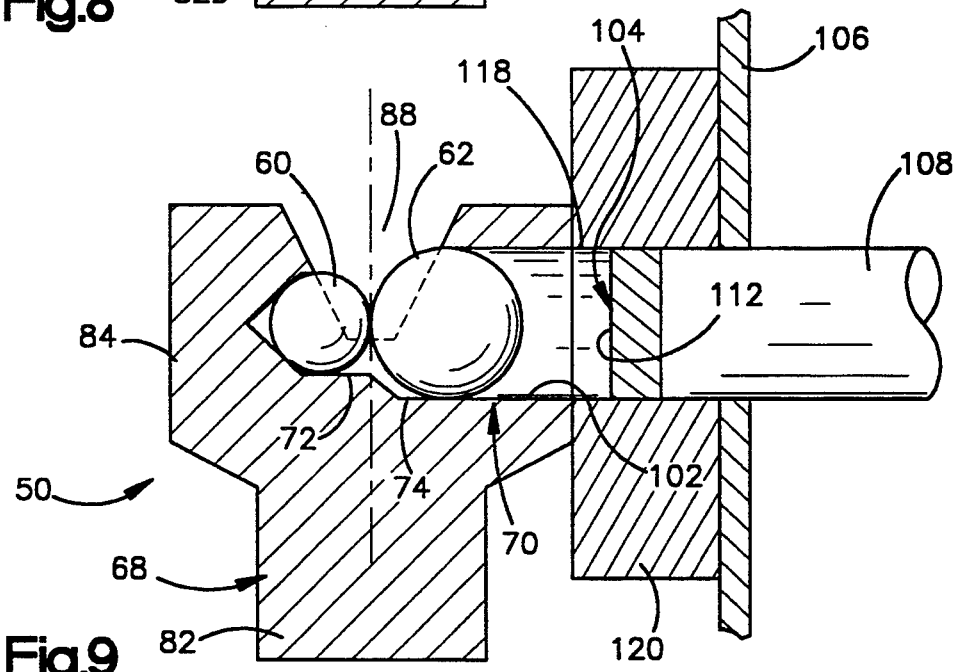
FIG. 9 is a schematic sectional view depicting the manner in which a punch removes material from a sheet and inserts the material into an open end of a recess in which spheres are located in a string support assembly.

In accordance with another feature of the present invention, the circular disc-shaped pieces 104 are removed from a sheet 106 of material by a punch 108 (FIG. 9). The punch 108 presses a circular disc-shaped piece 104 of material removed from the sheet 106 into the open end portion 102 of the recess 70. As the disc 104 is pressed into the open end portion 102 of the recess 70, the circular leading side surface 112 (FIG. 9) of the disc 104 moves into abutting engagement with the outer side surface of the sphere 62. The punch 108 presses the circular disc lightly against the sphere 62 to press the sphere against the adjacent sphere 60.

When the string support assembly 50 is to be formed, the body 68 of the string support assembly 50 is formed from a single piece of material. The recess 70 and slot 88 are formed in the body 68. The recess 70 extends only part way through the body 68. The small sphere 60 is inserted into the recess 70 and moves into abutting engagement with a closed end of the inner portion 72 of the recess 70. The sphere 62 is then inserted into the recess 70 into abutting engagement with the sphere 60.

After the two spheres 60 and 62 have been inserted through the open end portion 102 of the recess 70, the open end portion of the recess is blocked. Thus, a circular opening 118 (FIG. 9) in a die 120 is aligned with the circular open end portion 102 of the recess 70. The sheet 106 is placed in engagement with a side of the die 120 opposite from the body 68 of the string support assembly 50.

The punch 108 is then pressed against the sheet 106 of material and cooperates with the die 120 in such a manner as to cut a circular disc 104 of material from the sheet 106. Continued leftward (as viewed in FIG. 9) movement of the punch 108 relative to the stationary die 120 presses the circular disc 104 removed from the sheet 106 into the /pen end portion 102 of the recess 70 to block the recess. As the disc 104 is forced into the open end portion 102 of the recess 70, the leading side surface 112 of the disc presses lightly against the sphere 62 to press the sphere 62 against the adjacent sphere 60 and to press the sphere 60 against the inner end of the recess 70.

In view of the foregoing description, it is apparent that the present invention provides an improved string support system which is used in a musical instrument 10 of the guitar type. The musical instrument 10 has a plurality of strings 30–40 which extend from tuning devices 16–26 on a head portion 14, along a neck portion 12, to a body portion of the instrument. The improved string support system positions the strings 30–40 relative to the head and neck portions 14 and 12 of the instrument 10.

The string support system includes a plurality of string support assemblies 50. Each of the string support assemblies 50 has a pair of convex arcuate surfaces which cooperate to engage a string. The convex arcuate surfaces may be disposed on spherical members 60 and 62 having different diameters. The spherical members 60 and 62 may be rotatably held in a recess 70 formed in a support member 68. The support member 68 may be mounted directly in the material of the instrument.

The spherical members 60 and 62 are advantageously retained in a recess 70 by material 104 which is inserted into an open end 102 of the recess. To insert the material 104 in the open end of the recess, a punch 108 or similar member removes material from a sheet 106 of material. The punch 108 then presses the material 104 removed from the sheet 106 of material into the open end 102 of the recess 70.

Having described the invention, the following is claimed:

1. A string support for use in a stringed musical instrument of the guitar type and across which a string extends, said string support comprising first convex arcuate surface means which forms at least a portion of an outer side of a first sphere for engaging a first location on a side of the string, said first convex surface means having a first radius of curvature, second convex arcuate surface means which forms at least a portion of an outer side of a second sphere for engaging a second location on a side of the string, said second convex surface means having a second radius of curvature which is different than said first radius of curvature, and means for supporting said first and second convex arcuate surface means on the musical instrument.

2. A string support as set forth in claim 1 further including a first spherical member, said first convex arcuate surface means being disposed on said first spherical member, and a second spherical member, said second convex arcuate surface means being disposed on said second spherical member, said first and second spherical members having different diameters.

3. A string support as set forth in claim 2 wherein said first and second spherical members are disposed in abutting engagement.

4. A string support as set forth in claim 1 wherein said support means includes a support member at least partially disposed in a cylindrical opening, said first and second convex arcuate surface means being disposed on said support member.

5. A string support as set forth in claim 1 wherein said support means includes a support member disposed in abutting engagement with material of the stringed musical instrument, said first and second convex arcuate surface means being disposed on said support member.

6. A string support for use in a stringed musical instrument of the guitar type and across which a string extends, said string support comprising a first spherical member, a second spherical member, said second spherical member having a larger diameter than said first spherical member, and means for holding said first and second spherical members adjacent to each other while the string presses against said first and second spherical members.

7. A string support as set forth in claim 6 wherein said means for holding said first and second spherical members adjacent to each other allows said first spherical member to rotate about its center and allows said second spherical member to rotate about its center under the influence of force transmitted from the string to said first and second spherical members upon the occurrence of axial movement of the string.

8. A string support as set forth in claim 6 wherein said means for holding said first and second spherical members adjacent to each other includes a support body having a recess with an inner side surface which forms at least a portion of a first cylinder and at least a portion of a second cylinder, said second cylinder having a larger diameter than said first cylinder, said first and second spherical members being disposed in the recess with an /uter side surface of said first spherical member in engagement with an inner side surface area which forms the first cylinder and said second spherical member in engagement with an inner side surface area which forms the second cylinder.

9. A string support as set forth in claim 8 wherein the recess extends only part way through said support body, said means for holding said spherical members adjacent to each other includes means for blocking an end of the recess to retain said first and second spherical members in the recess.

10. A string support as set forth in claim 6 wherein said means for holding said first and second spherical members adjacent to each other includes a support body, surface means for defining a recess extending only part way through said support body, said recess having an end portion through which said first and second spherical members are inserted into said recess, said first and second spherical members being disposed in said recess in said support body, means for blocking the end portion of said recess to retain said spherical members in said recess, and means for forming a passage through which the string extends into and out of the recess to enable the string to engage said first and second spherical members while they are disposed in said recess.

11. A string support as set forth in claim 10 wherein said first and second spherical members are disposed in said recess with the centers of said first and second spherical members disposed along a longitudinal central axis of said recess.

12. A string support as set forth in claim 10 wherein the recess includes a first portion having a side surface with a circular cross sectional configuration of a first diameter and a second portion having a side surface with a circular cross sectional configuration of a second diameter which is larger than the first diameter, said first spherical member being disposed in engagement with the first portion of the recess, said second spherical member being disposed in engagement with the second portion of the recess.

13. A string support as set forth in claim 10 wherein the passage has a central axis which extends perpendicular to a central axis of said recess.

14. A string support as set forth in claim 10 wherein the first and second spherical members are rotatable in said recess under the influence of force applied against said first and second spherical members by the string upon axial movement of the string.

15. A string support as set forth in claim 6 wherein the stringed musical instrument is at least partially formed of wood, said means for holding said first and second cylindrical members including a support member at least partially disposed in an opening in the wooden material of the stringed musical instrument, said support member including surface means for defining a recess in which said first and second spherical members are disposed.

16. A method comprising the steps of providing a housing having a recess with an open end portion, inserting a plurality of spherical members having different diameters into the recess through the open end portion of the recess, and blocking the open end portion of the recess with the plurality of spherical members in the recess, said step of blocking the open end portion of the recess including the steps of removing material from a sheet of material and inserting the material removed from the sheet of material into the open end portion of the recess.

17. A method as set forth in claim 16 wherein said step of removing material from the sheet of material includes engaging a portion of the sheet material with a punch, said step of inserting the material removed from the sheet of material into the open end portion of the recess includes pressing the material removed from the sheet of material into the open end portion of the recess with the punch.

18. A method comprising the steps of providing a housing having a recess with an open end portion, inserting a plurality of spherical members into the recess through the open end portion of the recess, and blocking the open end portion of the recess with the plurality of spherical members in the recess, said step of blocking the open end portion of the recess including the steps of removing material from a sheet of material and inserting the material removed from the sheet of material into the open end portion of the recess, said step of blocking the open end portion of the recess includes aligning an opening in a die with the open end portion of the recess and positioning the sheet of material adjacent to the opening in the die, said step of removing material from the sheet of material includes engaging the sheet of material with a punch and forcing a portion of the material of the sheet of material into the opening in the die with the punch, said step of inserting the material removed from the sheet of material into the open end portion of the recess including pressing the material removed from the sheet of material into the open end portion of the recess with the punch.

19. A method as set forth in claim 18 wherein said step of inserting the material removed from the sheet of material into the open end portion of the recess includes engaging at least one of the spherical members with the material removed from the sheet of material.

20. A method as set firth in claim 18 further including the step of engaging the plurality of spherical members with a string of the musical instrument, said step of engaging the plurality of spherical members with a string of the musical instrument including applying force against the plurality of spherical members with the string of the musical instrument and pressing one of the spherical members against the material removed from the sheet of material under the influence of force transmitted from the string of the musical instrument to the one spherical member.

21. A method as set forth in claim 18 further including the steps of forming an opening adjacent to a connection between a head and neck portion of a musical instrument, positioning said housing in the opening after performing said step of blocking the open end portion of the recess with the plurality of spherical members in the recess, and, thereafter, engaging the plurality of spherical members with a string of the musical instrument.

22. A method as set forth in claim 18 wherein said step of inserting a plurality of spherical members into the recess includes inserting a plurality of spherical members having the same diameter into the recess.

23. A stringed musical instrument of the guitar type, said musical instrument comprising a body portion, a neck portion connected with and extending outwardly from said body portion, a head portion connected with said neck portion, a plurality of tuning devices mounted on said head portion, a plurality of strings each of which extends from one of said tuning devices along the neck portion to the body portion of said instrument, and a plurality of string supports mounted on said musical instrument adjacent to a connection between said head and neck portions, each of said string supports including a first convex arcuate surface which forms at least a portion of an outer side of a first sphere, said first convex arcuate surface having a first radius of curvature, a second convex arcuate surface which forms at least a portion of an outer side of a second sphere, said second convex arcuate surface having a second radius of curvature which is greater than said first radius /f curvature, and support means for supporting said first and second convex arcuate surfaces, said plurality of string supports being disposed in a linear array with each string of said plurality of strings being disposed in engagement with said first and second convex arcuate surfaces of one of said string supports.

24. A stringed musical instrument as set forth in claim 23 further including a linear array of spaced apart openings adjacent to the connection between said head and neck portions, said support means including a plurality of support members each of which is disposed in one of the openings.

25. A stringed musical instrument as set forth in claim 23 further including a linear array of spaced apart openings formed in material of said musical instrument adjacent to said head and neck portions, each of said string supports of said plurality of string supports being mounted in one of the openings formed in the material of said musical instrument and being spaced apart from adjacent string supports by the material of said musical instrument.

26. A stringed musical instrument as set forth in claim 23 wherein a first portion of one string of said plurality of strings extends from one tuning device of said plurality of tuning devices to one string support of said plurality of string supports and a second portion of said one string extends from said one tuning device along said neck portion of said musical instrument, said first portion of said one string having a longitudinal central axis which is skewed relative to a longitudinal axis of said second portion of said one string, said one string having an arcuate bend portion which is disposed in engagement with said first and second convex arcuate surfaces in said one string support, at least a portion of said arcuate bend portion of said one string having a radius of curvature which is the same as the radius of curvature of said second convex arcuate surface in said one string support.

27. A musical instrument as set forth in claim 26 wherein said arcuate bend portion of said one string has a center of curvature which is coincident with a center of curvature of said second convex arcuate surface in said one string support.

28. A musical instrument as set forth in claim 23 wherein said support means in each of said string supports includes a housing having a recess which extends only part way through said housing and has an end portion through 7hich said first and second convex arcuate surfaces are inserted into said recess, said end portion through which said first and second convex rial which is inserted into said recess after said first and second arcuate surfaces are inserted into said recess.

29. A musical instrument as set forth in claim 28 wherein said housing in each of said string supports includes means for forming a slot extending across said housing, one of said strings of said plurality of strings extending through the slot in each of said housings and engaging said first and second arcuate surfaces at a central portion of the slot.

30. A string support for use in a musical instrument, said string support comprising a housing, said housing having a first end portion adapted to be connected with the musical instrument and a second end portion, said first end portion of said housing having a cylindrical configuration and being adapted to be received in a cylindrical opening in the musical instrument, first surface means in said housing for forming a recess having an open end portion, first and second spherical members disposed in said recess in abutting engagement, means disposed in the open end portion of said recess to block the open end portion of said recess, one of said spherical members being disposed in abutting engagement with said means for blocking the open end portion of said recess, surface means for forming a slot which extends across said second end portion of said housing and which receives a string of the musical instrument, said slot intersecting said recess at a portion of said recess where said spherical members are disposed in abutting engagement to enable the string to engage said first and second spherical members adjacent to where said first and second spherical members are disposed in abutting engagement, said first end portion of said housing having a central axis which extends through an area of abutting engagement between said first and second spherical members and extends through a central portion of said slot.

31. A string support as set forth in claim 30 wherein said recess extends only part way through said housing, said housing having surface means forming an end surface of said recess, one of said spherical members being disposed in abutting engagement with said end surface of said recess.

32. A string support as set forth in claim 30 wherein said first and second spherical members have the same diameter.

33. A string support as set forth in claim 30 wherein said second spherical member has a larger diameter than said first spherical member.

34. A method comprising the steps of providing a housing having a recess with an open end portion, said step of providing a housing having a recess with an open end portion including providing a housing having a second opening, inserting a plurality of spherical members into the recess through the open end portion of the recess, said step of inserting a plurality of spherical members into the recess in the housing including positioning the spherical members in the housing with portions of each of the spherical members exposed through the second opening, blocking the open end portion of the recess with the plurality of spherical members in the recess, said step of blocking the open end portion of the recess including the steps of removing material from a sheet of material and inserting the material removed from the sheet of material into the open end portion of the recess, and moving a portion of a string of the musical instrument through the second opening in the housing into engagement with each of the spherical members after performing said step of blocking the open end portion of the recess.

35. A method as set forth in claim 34 wherein said step of removing material from the sheet of material includes engaging a portion of the sheet material with a punch, said step of inserting the material removed from the sheet of material into the open end portion of the recess includes pressing the material removed from the sheet of material into the open end portion of the recess with the punch.

36. A method as set forth in claim 34 wherein said step of inserting the material removed from the sheet of material into the open end portion of the recess includes engaging at least one of the spherical members with the material removed from the sheet of material.

37. A method as set forth in claim 34 wherein said step of blocking the open end portion of the recess includes aligning an opening in a die with the open end portion of the recess and positioning the sheet of material adjacent to the opening in the die, said step of removing material from the sheet of material includes engaging the sheet of material with a punch and forcing a portion of the material of the sheet of material into the opening in the die with the punch, said step of inserting the material removed from the sheet of material into the open end portion of the recess includes pressing the material removed from the sheet of material into the open end portion of the recess with the punch.

38. A method as set forth in claim 34 said step of moving a portion of a string of a musical instrument through the second opening in the housing includes applying force against the plurality of spherical members with the string of the musical instrument and pressing one of the spherical members against the material removed from the sheet of material under the influence of force transmitted from the string of the musical instrument to the one spherical member.

39. A method as set forth in claim 34 further including the steps of forming an opening adjacent to a connection between a head and neck portion of a musical instrument, positioning said housing in the opening after performing said step of blocking the open end portion of the recess with the plurality of spherical members in the recess, and, thereafter, performing said step of moving a portion of a string of the musical instrument through the second opening into engagement with each of the spherical members.

40. A method as set forth in claim 34 wherein said step of inserting a plurality of spherical members into the recess includes inserting a plurality of spherical members having the same diameter into the recess.

41. A method as set forth in claim 34 wherein said step of inserting a plurality of spherical members into the recess includes inserting spherical members having different diameters into the recess.

42. A string support for use in a musical instrument, said string support comprising a housing, said housing having a first end portion adapted to be connected with the musical instrument and a second end portion, first surface means in said housing for forming a recess having an open end portion, first and second spherical members disposed in said recess in abutting engagement, said second spherical member having a larger diameter than said first spherical member, means disposed in the open end portion of said recess to block the open end portion of said recess, one of said spherical members being disposed in abutting engagement with said means for blocking the open end portion of said recess, surface means for forming a slot which extends across said second end portion of said housing and which receives a string of the musical instrument, said slot intersecting said recess at a portion of said recess where said spherical members are disposed in abutting engagement to enable the string to engage said first and second spherical members adjacent to where said first and second spherical members are disposed in abutting engagement.

* * * * *

UNITED STATES PATENT AND TRADEMARK OFFICE

CERTIFICATE OF CORRECTION

PATENT NO. : 5,394,783
DATED : March 7, 1995
INVENTOR(S) : Robert J. Sperzel

It is certified that error appears in the above-indentified patent and that said Letters Patent is hereby corrected as shown below:

Column 8, line 66, change "/uter" to --outer--.

Column 10, line 34, change "firth" to --forth--.

Column 11, line 7, change "/f" to --of--.

Column 11, line 55, change "7hich" to --which--.

Column 11, lines 57-58, after "portion" delete --through which said first and second convex rial which is inserted into--.

Column 11, line 58, before "said" insert --of--.

Column 11, line 58, after "recess" insert --being blocked by a piece of material which is inserted into said recess--.

Signed and Sealed this

Fourteenth Day of November, 1995

*Attest:*

*Attesting Officer*

BRUCE LEHMAN

*Commissioner of Patents and Trademarks*